United States Patent [19]

Tucom

[11] Patent Number: 4,667,847

[45] Date of Patent: May 26, 1987

[54] DISPENSER FOR GOLF BALLS

[76] Inventor: Paul Tucom, Zone Industrielle Boe, 47240 Bon Encontre, France

[21] Appl. No.: 733,451

[22] Filed: May 10, 1985

[30] Foreign Application Priority Data

May 10, 1984 [FR] France ..... 84 07383

[51] Int. Cl.[4] ..... B65D 83/04

[52] U.S. Cl. ..... 221/68; 221/183; 221/196; 221/200; 221/265

[58] Field of Search ..... 221/68, 93, 178, 183, 221/196, 200, 202, 203, 206, 265, 266

[56] References Cited

U.S. PATENT DOCUMENTS

| | | | |
|---|---|---|---|
| 2,786,566 | 3/1957 | Taggart et al. | 221/178 X |
| 2,915,217 | 12/1959 | Chaplinski | 221/68 |
| 3,417,542 | 12/1968 | Merrill et al. | 221/265 X |
| 3,946,847 | 3/1976 | Bock | 221/93 X |
| 4,054,197 | 10/1977 | Bock | 221/202 X |

FOREIGN PATENT DOCUMENTS

| | | |
|---|---|---|
| 1037916 | 7/1905 | Canada . |
| 984771 | 3/1965 | United Kingdom . |

*Primary Examiner*—F. J. Bartuska
*Attorney, Agent, or Firm*—Young & Thompson

[57] ABSTRACT

A dispenser for golf balls comprises an upper bin (1) containing the balls to be dispensed retained by means of an inclined plate (2) partially sealing the bin (1) so as to arrange in its lower portion an opening (3) for the passage of the balls. In order to avoid a significant bulk at the level of the opening (3) a second inclined plate (4) is arranged in an inverse sense to the perpendicular of the opening (3). A lower inclined ramp (5) is provided with perpendicular elements (7) defining channels (8) disposed opposite compartments (9) arranged on a rotating cylinder (10) in loading position at the extremity of the lower ramp (5). In an upper portion of the vertical elements (7) a closing plate (11) is connected in order to avoid the superposition of several layers of balls. Rotation of the cylinder (10) outputs the balls into a drain (18) responsive to the action of a crank (17) coupled to a coin receiver and to the cylinder (10). The rotation of the cylinder (10) actuates a pivotally mounted agitator maintained beneath the articulated plate (2). The agitator comprises spaced projections which extend the channels (8).

6 Claims, 8 Drawing Figures

Figure 5:
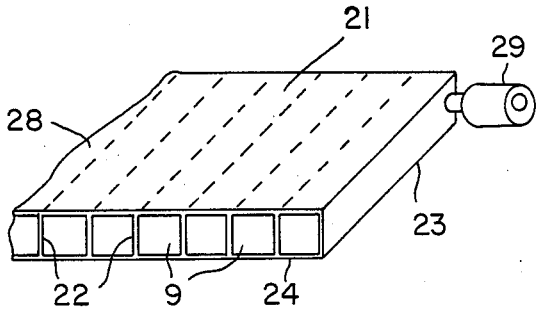

FIG. 1
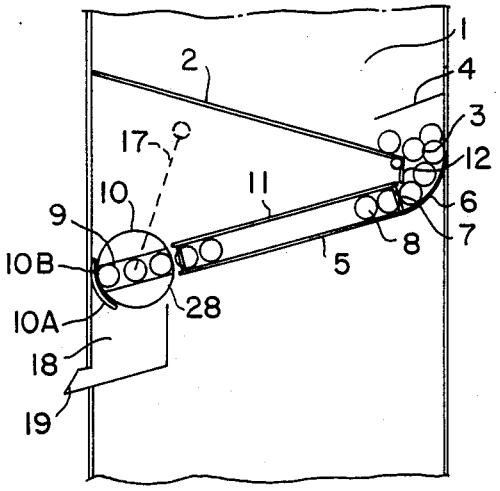
FIG. 2
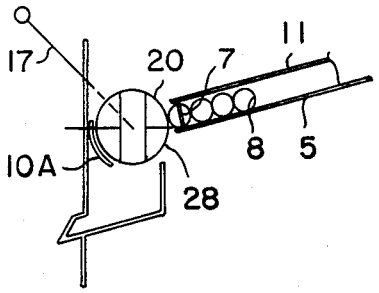
FIG. 3
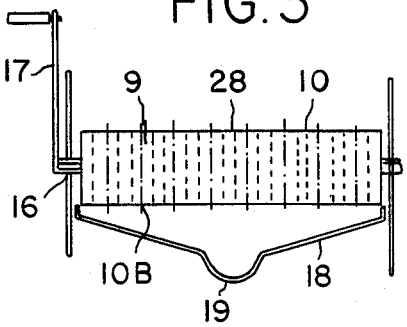
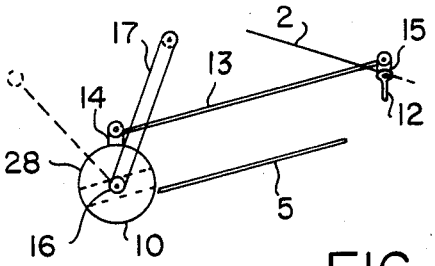
FIG. 4

DISPENSER FOR GOLF BALLS

The present invention relates to a dispenser for golf balls in defined quantities.

U.S. Pat. No. 3,946,847 teaches a machine for the dispensing of golf balls comprising an upper storage bin for balls in a lower portion of which an inclined plate retains the balls while directing them toward a horizontal opening where the balls are recovered on a lower ramp oppositely inclined and having the vertical passage between the upper inclined plate and the lower ramp partially sealed by a rotatable gate extending toward the base in closed position permitting nevertheless the passage of a layer of balls which are channeled and contained in vertical channels at the perpendicular of compartments arranged on a rotatable cylinder permitting during its rotation by means of an exterior crank coupled to a coin receiver, the discharge of the balls contained in the latter by the peripheral material constituting the cylinder. In order to complete the dispensing, that is, to avoid the jamming of balls at the level of the upper horizontal opening and across the vertical passage between the upper inclined plate and the lower ramp, the gate during the action of the crank causing rotation of the cylinder effects a 90° rotation of the group of balls so as to disperse these latter and facilitate their discharge and distribution opposite the channels across vertical guides arranged on the lower ramp. This type of machine is not viable as the balls during action of the rotating gate are subject to blockages due to the weight of the balls contained in the bin, on the other hand on the inclined ramp a certain number of balls distribute themselves over several levels, thus causing their accumulation at rest against the vertical wall of the machine and against the upper wall of the vertical channels if these latter are at rest on the said wall or between the vertical wall and the channels.

According to U.S. Pat. No. 4,054,197 of the same patentee, the inclined lower ramp is extended by a rotating half-cylinder sealed by means of a crank arm as described above, the diameter of the said half-cylinder sealed by a planar sheet extending from the inclined plate of such kind that the excess of balls is maintained on the inclined plate by the peripheral material constituting the half-cylinder. This variant does not allow the exact discharge of the number of balls as these latter are sent toward the half-cylinder in bulk, and on the other hand the action of the movable gate provokes as described above a division over several levels.

The dispenser which is the object of the invention remedies the disadvantages described above.

It comprises an upper bin containing the balls to be dispensed retained by means of an inclined plate partially sealing the bin so as to arrange in its lower portion an opening for the passage of the balls. So as to avoid a significant bulk at the level of the opening extending the inclined plate due to the weight of the balls, and their eventual jamming, a second inclined plate arranged in reverse direction to the perpendicular of the opening, is disposed above the principal inclined plate so as to arrange between the said principal plate and the end of the second inclined plate, a vertical passage for the routing of the balls toward the opening in the lower portion of the principal inclined plate, across which the balls pass and are recovered on an inclined ramp equipped with vertical elements constituting conduits placed opposite chambers arranged on a rotating dispenser at the end of the said ramp, in an upper portion of the vertical elements a closure plate seals these latter so as to avoid the superposition of several layers of balls interfering with the proper operation of the dispenser. In order to avoid a jamming of the balls at the level of the opening in the lower part of the principal inclined plate, an agitator is disposed beneath the said plate, it being activated by lever and connecting rod at the moment of action of an exterior crank arm causing the rotation of the rotating distributer containing the defined number of balls in its chambers and their discharge.

Figure 6:
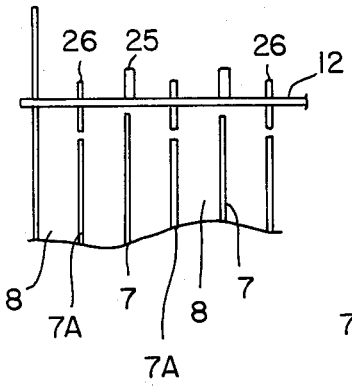
Figure 7:
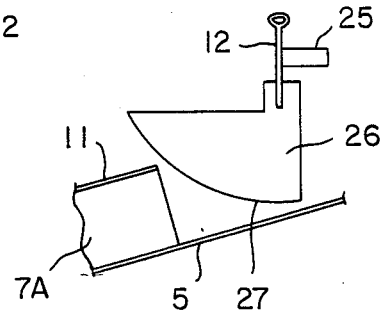
Figure 8:
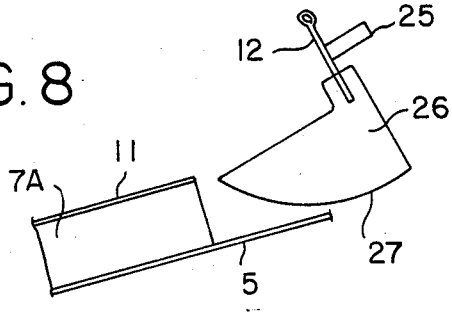

Other characteristics and features of the invention will be more clearly evident from the following description made with regard to the accompanying drawings as a non-limiting example, where:

FIG. 1 is a view in section of a dispenser provided with a rotating dispenser cylinder in loaded position, FIG. 2, a view in section of the dispensing cylinder in discharge position, FIG. 3, a frontal view of the dispenser, FIG. 4, a view in section of the agitator and its drive mechanism, FIG. 5, a variation of the rotating dispenser, FIG. 6, a top view of an agitator variant, FIG. 7, a view in section of the agitator of FIG. 6 in rest position, and FIG. 8, a view in section of the agitator of FIG. 6 in release position.

As shown in FIGS. 1 to 3, the dispenser comprises an upper bin 1 containing the balls to be dispensed in a lower portion of which is fixed an inclined principal plate 2 of partial closing, in a lower portion of the said plate is arranged an opening 3 for allowing the passage of the balls, above which is fixed a second inclined plate 4 in inverse relation to the plate 2 and for avoiding a significant quantity of balls at the level of the opening 3 where they are recovered on an inclined ramp 5 presenting a curve 6 to facilitate their flow. On the inclined ramp 5 vertical elements 7 are fixed, which constitute side channels 8 in extension of cylindrical, square and/or rectangular compartments 9 arranged in the rotating dispenser 28 of cylindrical form 10 the diameter of which defines the number of balls contained therein the compartments 9 passing through the cylinder from one side to the other and so as to maintain the balls during the loading a rounded sheet 10A is maintained on the frame of the dispenser, which seals the extremity 10B of the compartments 9. So as to avoid the superposition of several layers of balls impeding the dispensing, in an upper portion of the inclined ramp 5 and on the vertical elements 7 a closing plate 11 is provided, which extends the opening 3 so as to permit the introduction of the balls in the channels 8, introduction facilitated by an agitator 12 disposed beneath the inclined plate 2 and between the closing plate 11, the said agitator 12 is actuated as shown in FIG. 4 by means of a connecting rod 13 connected to levers 14 and 15, the lever 14 being firmly connected with the support shaft 16 of rotating cylinder 10, the said shaft being extended by a crank 17 permitting the rotation of the cylinder 10 when the latter is set free by means of a coin receiver not shown and thus the discharge of the balls contained in the compartment 9 when the extremity 10B is detached from the sheet 10A, the discharged balls being recovered in a drain 18 directing the said balls toward the dispensing spout 19. Prior to the discharge of the balls contained in the compartments 9 of the cylinder 10, the excess balls contained in the channels 8 are immobilized in the said channels 8 by the peripheral material 20 constituting the cylinder 10.

According to the embodiment shown in FIG. 5, the rotating dispenser 28 may advantageously be replaced by a parallelepipedal element 21 at the interior of which the compartments 9 of cylindrical, square and/or rectangular section are arranged by vertical separation elements 22 and/or tubing not shown, the section of compartments 9 is slightly larger than that of a golf ball, the width of the parallelepipedal element 21 corresponds to the defined number of balls to be dispensed, so as to cause the rotation of the parallelepipedal dispenser 21, this latter in its extremity opposed to the sheet 10A is articulated on pivots 29 of which the one is joined to the mechanism acted on by the crank 17, as described above, at the time of the discharge of the balls contained in the compartments 9 of the parallelepipedal dispenser 21 the excess balls contained in the channels 8 are immobilized by the material 23 at the level of the pivots 29 constituting the inner surface 24 of the said dispenser 21.

As shown in FIGS. 6, 7 and 8, and so as to complete the distribution of the balls in the channels 8, the agitator 12 is provided with projecting wedges 25, these latter are disposed opposite the vertical elements 7 in alternation with the vertical elements 7A of lesser length opposite which are maintained on the agitator 12 vertical guides 26 presenting a rounded form in their extremity 27 and this so as to extend the said elements 7A and to complete the agitation and distribution of the balls in the columns 8.

I claim:

1. In a dispenser for golf balls comprising an upper bin for containing the balls to be dispensed, a first inclined plate partially sealing said bin and defining at its lowermost edge an opening for passage of said balls, a second plate inclined oppositely to said first plate and disposed in said bin beneath said opening for receiving balls conveyed through said opening, and means disposed downstream of said second plate for dispensing said balls, said second plate comprising a plurality of parallel partitions defining a plurality of channels for arranging said balls in a plurality of single columns, the improvement comprising: an agitating gate pivotally mounted beneath said lowermost edge of said first plate and means for pivoting said gate, said gate comprising a plurality of spaced projections, said plurality of projections being aligned with said plurality of partitions, whereby pivoting of said gate will extend said plurality of columns along the trajectory of said gate.

2. Dispenser according to claim 1, and a third plate inclined oppositely to said first plate, said third plate being disposed above said opening for preventing a pile of said balls from accumulating above said opening.

3. Dispenser according to claim 1, and a fourth inclined plate parallel to said second inclined plate and fixed to said plurality of parallel partitions, thereby to define with said second plate and said partitions a plurality of channels having four closed sides, said fourth plate extending adjacent said opening.

4. Dispenser according to claim 1, wherein said second inclined plate comprises a curved ramp portion disposed beneath said opening.

5. Dispenser according to claim 1, wherein said means for dispensing said balls comprises a rotary dispensing head actuated by a hand crank, and said means for pivoting said gate operate responsive to rotation of said hand crank.

6. Dispenser according to claim 1, wherein said plurality of spaced projections of said gate comprise a plurality of blade-like projections extending toward said partitions, alternating with a plurality of wedge-like projections extending away from said plurality of partitions, said plurality of partitions comprising first partitions aligned with said wedge-like projections and extending up to said gate, said first partitions alternating with shorter second partitions extending up to said blade-like projections.

* * * * *